United States Patent [19]

Browne et al.

[11] Patent Number: 4,457,577

[45] Date of Patent: Jul. 3, 1984

[54] CABLE TRAY GROUND CLAMP

[75] Inventors: Frank L. Browne, Bristol; Walter W. Bachle, Harwinton, both of Conn.

[73] Assignee: General Signal Corporation, Stamford, Conn.

[21] Appl. No.: 415,128

[22] Filed: Sep. 7, 1982

[51] Int. Cl.[3] ..... H01R 4/66

[52] U.S. Cl. ..... 339/14 L; 339/263 L; 339/272 UC

[58] Field of Search ..... 339/14 R, 14 L, 202 R, 339/263 L, 265 F, 266 G, 272 UC

[56] References Cited

U.S. PATENT DOCUMENTS 2,947,967 8/1960 Waldrop ..... 339/272 UC

FOREIGN PATENT DOCUMENTS 2059180 4/1981 United Kingdom ..... 339/272 R

*Primary Examiner*—Eugene F. Desmond

*Attorney, Agent, or Firm*—Milton E. Kleinman; Martin LuKacher

[57] ABSTRACT

A cable tray grounding clamp which comprises two conjoined clamps, for electrically connecting a cable tray, or the like, and a grounding conductor. The body of the conjoined clamps is a high yield strength material for providing strength and rigidity to permit application of appropriate pressure. A conducting member overlays the anvil portion of the body member, and is supported thereby, whereby when the cable tray clamp is secured to a cable tray and a grounding wire both the tray and the grounding wire are in contact with the conducting member to thereby provide a low resistance path between the tray and the grounding wire.

5 Claims, 4 Drawing Figures

CABLE TRAY GROUND CLAMP

BACKGROUND OF THE INVENTION

As wiring and electrical power distribution systems have become more sophisticated and as greater attention has been focused on the safety of personnel who must work on, in, and around such equipment, much ingenuity and inventive power has been applied to increase safety and minimize the possibility of any inadvertent electrical shock. A principal concept to assure safety is that of connecting all exposed metallic surfaces to ground potential which means quite literally, an electrical continuity to the earth. If all exposed metal surfaces are at gound potential, then there can be little, if any, electrical potential between any two surfaces and/or any surface and the earth and therefore, an individual touching any of these surfaces either singly or in combination, will not be subjected to a potential difference and the possibility of an electric shock.

This principle, in concept, is very sound. However, practicing the principle without any deviation, especially in the event of some fault condition, has not always been as simple and obvious as it might appear. An obvious possibility of danger is a discontinuity or interruption of the ground connection. To avoid this possibility, ground connections never pass through switches nor are any fuses or circuit breakers included in ground connections. Making a good connection to the earth is a study in itself and the techniques will vary depending upon the composition of the earth and the normal weather conditions. Since the techniques used are well known to those skilled in the appropriate arts and since such techniques do not have a direct bearing on the structure to be described, no further mention will be made thereof.

One of the more obvious ways in which a ground connection may be inadvertently disconnected from an exposed metallic surface will occur when the ground connector is called upon to carry a larger current than its physical characteristics and/or the quality of its electrical connection will allow. In such a situation, the ground conductor or connector may melt or vaporize, and interrupt the ground connection thereby leaving exposed metal surfaces at a dangerous potential. To avoid this possibility, it is obvious that the ground conductor and connectors must be capable of carrying a current at least as large as any which they might be called upon to carry in the event of the worst possible fault condition that can be conceived.

An exposed metal surface may not be at ground potential even when the ground connector is connected thereto if there is any substantial resistance between the exposed metal surface and the ultimate ground connection. Excessive resistance in the ground connection may result from faulty equipment design and/or faulty installation or connection. It may also result from part of the ground connection being required to pass through members which do not have a sufficiently low resistance and/or an adequate cross sectional area of the conducting member.

U.S. Pat. No. 3,365,693 issued Jan. 23, 1968 to F. L. Browne discloses a grounding lug suitable for connecting to a conduit fitting and the like.

U.S. Pat. No. 3,706,959 issued Dec. 19, 1972 to A. R. Norden discloses a ground connector for a conduit.

U.S. Pat. No. 4,248,490 issued Feb. 3, 1982 to W. W. Bachle discloses a lay-in lug having a conduction pad for reducing the resistance between the ground conductor and the bushing to be grounded by the grounding conductor.

U.S. Pat. No. 4,320,882 issued May 23, 1982 to W. W. Bachle discloses a ground clamp for providing increased conductivity between a conduit member and a cable tray or structural member. Each of these patents is assigned to the same assignee as the present invention.

DESCRIPTION OF PRIOR ART

One of the difficulties experienced with the devices of the prior art for coupling a grounding conductor to an exposed metallic surface is that the coupling device itself is usually an inferior conductor as compared with the grounding conductor. Accordingly, in the event of a fault condition, a very substantial current, which may be measured in the thousands of amperes, may be required to flow through the coupling member for coupling the grounding conductor, which is usually made of copper, to the exposed metal surface. With some structures, such fault currents are sometimes concentrated in a screw which clamps the members together. The large current may melt and/or vaporize the screw causing the body member to become electrically isolated from the exposed metal surface thereby terminating the ground protection that had been intended. Some of the above-cited patents describe specific techniques for assuring that the body member is capable of conducting at least as much current as the gound conductor.

The structure of the present invention is particularly designed and configured to assure a low resistance connection between the grounding conductor and the exposed metallic surface, such as a cable tray of the like, to which the grounding conductor is to be electrically connected.

SUMMARY OF THE INVENTION

The present invention provides a structure comprising first and second conjoined clamps, one of which securely clamps the grounding conductor and the other of which securely clamps the exposed metallic surface to which the grounding conductor is to be electrically connected. The exposed metallic may typically comprise a cable tray or the like. Since the body of the dual clamp member must have considerable strength and low yield to permit application of appropriate pressure, it is not practical to make the body member of a good electrical conductor such as copper, aluminum, brass or any of the other metals or alloys commonly though of as good electrical conductors. Accordingly, prior art devices have attempted to compensate for the reduced current carrying capacity per unit cross section by increasing the available cross sectional area. This results in increased cost, weight and bulk. The present structure employs a high yield strength body member with two conjoined clamps, one of which securely clamps the grounding member between a screw and an anvil surface of the clamp. In like manner, the other one of the conjoined clamp members clamps the cable tray, or the like, between a clamping screw and an opposed anvil surface. In order to increase the conductivity between the two anvil surfaces, and therefore, reduce the resistance between the grounding conductor and the cable tray, or the like, an overlay member is situated over each of the anvil surfaces and connected together. In a preferred embodiment, the overlay member comprises a good electrical conductor configured to be a single piece and overlay both anvil surfaces. The overlaying member should have a current carrying capacity equal to that of the grounding conductor. By this means, a superior grounding connection is provided between the grounding conductor and the cable tray thereby eliminating the need to increase the size of the conjoined clamping member beyond that required to provide the necessary strength and rigidity in order to increase the current carrying capacity. By this means, an improved and secure grounding connection may be provided with a smaller and more economical grounding clamp.

It is an object of the present invention to provide a new and improved cable tray ground clamp.

It is a more specific object of the invention to provide a new and improved cable tray ground clamp which will be smaller and more economical than prior art cable tray ground clamps having the improved current carrying capacity.

It is another more specific object of the invention to provide a conjoined dual clamping device for clamping a grounding wire and a metallic surface each between a respective clamp and anvil and with a low resistance conductor overlaying one anvil surface and extending to and overlaying the other anvil surface.

It is another object of the invention to provide an improved cable tray ground clamp wherein the major portion of a ground fault current will be conducted primarily through a low resistance member extending between the anvils of the two clamps rather than through the body member.

Still another object of the present invention is to provide an improved ground clamp which substantially overcomes the disadvantages of the described prior art constructions and provides a structure characterized by its reliability, ruggedness, ease and convenience of use, simplicity and low cost together witth high versatility and adaptability.

BRIEF DESCRIPTION OF THE DRAWING

Further objects and advantages of the structure of the invention will become more apparent as the following description is considered together will the accompanying drawing in which.

In order to facilitate reference to the various elements, each element is given the same identification number in all views.

DESCRIPTION OF THE PREFERRED EMBODIMENT

The primary function of the cable tray ground clamp is to provide a conjoined dual clamping device for clamping a grounding wire and a metallic surface each between a respective clamp and anvil in such a manner as to provide a minimum possible resistance between the grounding wire and the metallic surface. The minimum resistance is expeditiously and economically provided by means of a novel design of the conjoined clamp body which permits the use of a low resistance conductor which overlays one anvil surface and extends to and overlays the other anvil surface. Thus, any members secured by the two clamps of the conjoined clamping device will be electrically coupled by a low resistance conduction member.

Figure 3:
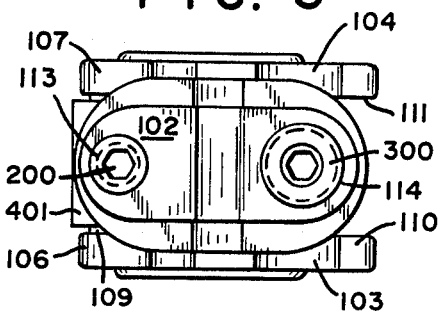
FIG. 3 is a top view.
Figure 1:
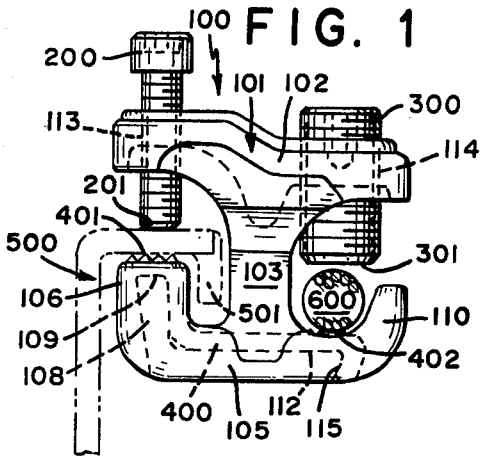
FIG. 1 comprises a side view of the structure.

Considering now more specifically the drawing and particularly FIG. 1, there will be seen a cable tray ground clamp indicated generally as 100 and comprising a body member indicated generally as 101, a cable tray clamping screw indicated generally as 200 and a grounding conductor clamping screw indicated generally as 300.

While the clamping device described herein is set forth as providing an electrical connection between a cable tray and a grounding wire, it should be understood that this represents only a typical use. More specifically, the clamp could be used in a wide variety of other applications and such other applications might require modified designs and/or differences in proportions. For example, the device might be used to couple together two grounding wires; to couple a grounding wire to a conduit member or any of a wide variety of other applications wherein it is expedient to electrically couple two members together to assure that they are both at the same potential.

As illustrated to FIG. 1, the clamp 100 is used for coupling a cable tray, or the like, indicated generally as 500 to a grounding conductor 600. Although the grounding conductor 600 is ilustrated in cross section in FIG. 1 as a circle, it should be understood that in a typical application, the grounding wire 600 would normally comprise a plurality of smaller conductors, each of which is normally circular, arranged in close proximity, one to the other, so that the overall outline approximates that of a circle.

The actual configuration of the body 101 may be most expeditiously visualized by considering together and comparing all four figures of the drawing. The body member 100 may be seen to comprise four principal parts: the top or head member 102; the side members 103 and 104 and the bottom or anvil member 105. Normally, the sides 103 and 104 will be substantially identical, although left and right handed. In the illustrated embodiment, the anvil 105 has the general configuration of a capital L laid on its back and extending between the two sides 103 and 104. Although not a very accurate description, the two side members 103 and 104 have somewhat the appearance of the capital H laid on the side. The sides 103 and 104 have corresponding first upturned portions 106 and 107, respectively. Extending between the upturned portions 106 and 107 is the shorter leg 108 of the anvil member 105 facing upward on the leg 108 is anvil surface 109.

Each of the sides 103 and 104 also includes a secons upturned portion 110 and 111, respectively. Near the right-hand end, as seen in FIG. 1 of the anvil member 105, is an anvil surface 112.

The top or head member 102 includes threaded holes 113 and 114 for accommodating the screws, or bolts, 200 and 300, respectively. As may be readily visualized when the bolts 200 and 300 are placed in their respective threaded holes 113 and 114 and turned downward, the lower ends 201 and 301 will face their respective anvil surfaces 109 and 112. Accordingly, it will be evident that any member placed on anvil surface 109 and 112 may be clamped in position by the threaded members 200 or 300. It will further be evident that if the body member 101 and/or anvil member 105 and/or bolts 200 and 300 are fabricated of a material that is capable of conducting electrical current that any member clamped to anvil surface 109 will be in electrical continuity with any element clamped to anvil surface 112.

Although the structural characteristics of prior art devices may differ meterially from those of the present structure as thus far described, the electrical characteristics would be similar. More specifically, the structure as thus far described, would require electrical current to pass through the anvil member 105. If the anvil member 105 and/or other portions of the body 101, which may also conduct electricity, are fabricated from the class of materials which constitute good electrical conductors, it would be found that either the body member 101 would be excessively and inconveniently large and bulky in order to allow application of appropriate pressures to the members clamped between the anvil surfaces 109 and 112 and their respective clamping bolts 200 and 300. If the body member 102 is made of a high yield strength material, in order to permit the application of the required pressures, it will be found that the body member 102 will have to be inordinately large in order to be able to pass the required ground fault current. Thus, with either selection of material, the unit would be larger to satisfy requirements of strength and conductivity.

It should be understood that under ground fault conditions, a very large current may pass between the members secured by the grounding clamp 100. Such ground fault current may rise to several thousands of amperes. Unless good conductivity is provided between the members, the large current may cause sufficient heat or melt or even vaporize the conduction path. This may result in loss of the grounding connection, circuit failure, danger to personnel and equipment, damage or fire. Accordingly, considerable effort and ingenuity has been devoted to designing grounding systems and clamps which are capable of carrying the fault current. It should be recognized that under normal operating conditions, any current passing through the clamp 100 will be very small. However, in the event of some very abnormal, undesired and undesirable conditions, a live or "hot" conductor may come in contact, either directly or indirectly, with one of the members clamped by the device 100. In such an eventuality, it is important that the clamp 100 and the grounding wire 600 be capable of conducting the fault current to ground until such time as a circuit breaker or switch may be activated to terminate the flow of the fault current. The danger is very real and the conditions which may create it are difficult to anticipate and test.

The conjoined clamps of the clamp 100, when tightened, comprise a highly stressed structure and must, therefore, be fabricated of suitable material having a high yield strength. If a high yield strength material is not used, adequate pressure could not be applied to the members. And if adequate pressure cannot be applied, the electrical contact will be inferior. Inferior electrical contact adds resistance which can cause a hot spot under fault conditions resulting in the described melting or vaporization. A body member 101 comprising a good conductor will not have the required yield strength unless inordinately large. And a body member 101 which has an appropriate yield strength will not have a sufficiently low electrical resistance unless inordinately large.

Figure 4:
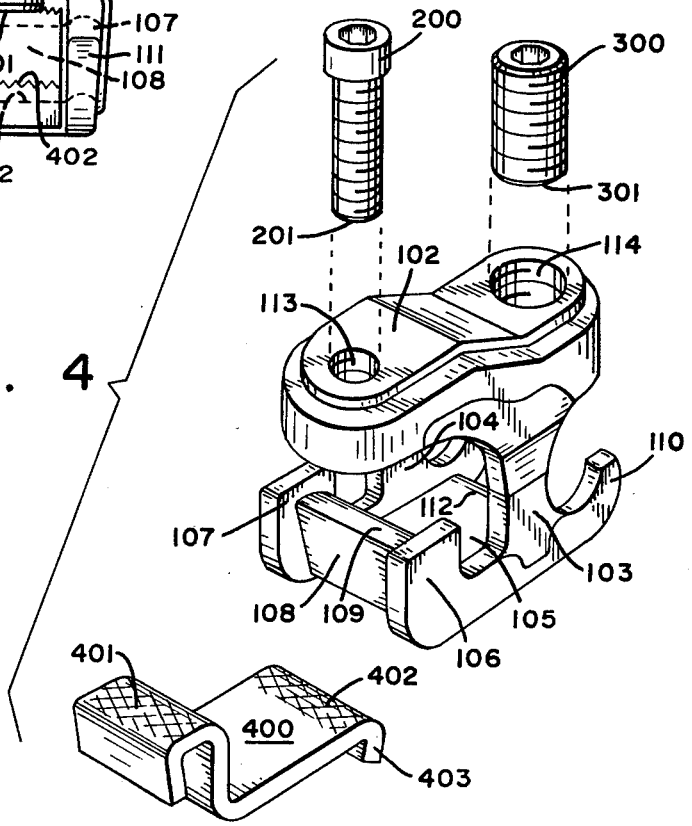
FIG. 4 is an exploded perspective view of the structure.

In order to provide a structure which is of a convenient and economical size and yet which has both the required high yield strength and high conductivity, a grounding bar 400 is provided. The grounding bar 400 is most conveniently seen in FIG. 4 and typically comprises a tinned copper or copper alloy ground bar. Other suitable conductors could be provided to meet the exigencies and requirements of particular applications. In general, the ground bar 400 is designed to be capable of conducting at least much current as the largest size of grounding cable 600 with which the fitting 100 may be used. As may be seen from the various figures, the grounding bar 400 includes first and second anvil surfaces 401 and 402 which are configured to overlay the anvil surfaces 109 and 112, respectively. The first anvil surface 401 rises above the first upturned portion 106 of the side 103. Thus, when a cable tray, or the like 500, is clamped between anvil surface 401 and the bolt 200, the full pressure is brought to bear on the anvil surface 401. In some cable tray configurations, the cable tray 500 may include a lip 501. It is to accommodate such lip 501 that the side 103 includes a first upturned portion 106. If it were not necessary to accommodate cable trays, or the like, with lips 501, it will be apparent that a modified configuration of the body member 101 could be provided.

The body member 101 may be made of any appropriate material having the requisite high yield strength. The use of malleable iron which is either cadmium or zinc plated would comprise a suitable selection. Typically, the screws 200 and 300 may comprise zinc or cadmium plated steel screws. The screws 200 and 300 may be provided with hex heads for wrench tightening or hex wells for tightening with hex wrenches, or any other convenient form. Naturally, any other suitable form for turning the screws 200 and 300 may be used.

Because the grounding bar 400 is a superior electrical conductor as compared with the conductivity of the body member 101, it should be understood that in response to any fault condition requiring the flow of current between a cable tray 500 and a ground conductor 600, that the bulk of such fault current will pass through the grounding bar 400. However, the grounding bar 400 is in direct contact with the bottom anvil 105 and it, in turn, is in contact with the side members 103 and 104 which, in turn, are in contact with the top member 102. Accordingly, it may be anticipated that some current will pass through these members 101 and some may even pass through the screws 200 and 300. Although these members are not good conductors, there is no possibility they will be overheated and melt or vaporize inasmuch as most of the current will pass through the lower resistance path grounding bar 400 as current always takes the path of least resistance.

The anvil surfaces 401 and 402 of the ground bar 400 may have serrations as indicated in the various figures in order to improve the electrical contact between these surfaces and the members clamped to them. According to good practice and to assure proper and efficient operation of the cable tray ground clamp in a system, it should be understood that the surfaces of the cable tray 500 which are clamped by the device 100, particularly that part in contact with the anvil surface 401, must be free of paint, oxides and any other material which would increase the resistance between such surface and the anvil 401. It should go without saying that the conductor 600 must have its insulation removed.

The upturned portions 110 and 111 provide a generally C-shaped entry way for the grounding cable 600 to be laid therein and thereby permit laying in of the grounding cable 600 without need to cut the cable 600 if it is to be extended to other grounding clamps of a similar or other nature. Furthermore, the upturned portions 110 and 111 help secure the grounding cable 600 in its proper location and orientation during assembly and before the screw 300 is tightened.

The body member 101 includes various ribs, angles, curvatures, thicknesses and set backs, all of which contribute to an overall appearance but some of which have little overall functionality other than those already described. That is, the body member 101 is designed to provide the necessary and appropriate combination of accessability, economy and convenience of use, manufacture and assembly combined with the necessary strength. Any number of other configurations could be made without departing from the principles herein disclosed.

If desired, the ground bar 400 could be secured to the body member 102 by any of a wide variety of convenient and expeditious means. For examle, the lip 403 of the ground bar 400 could be configured to yieldingly snap over the end 115 of the anvil 105. As described and illustrated, the ground bar or conduction member is situated within the interior of the body member. It will be appreciated that, if desired, the ground bar could extend from anvil surface 109 to anvil surface 112 by being formed around the lower portion of anvil member 105, as viewed in FIG. 1. Normally, this technique would not be expedient or economical as it would require and increased volume of ground bar.

Figure 2:
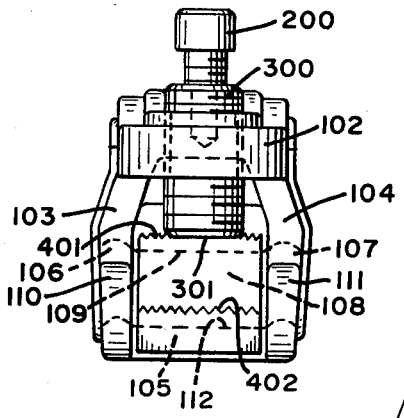
FIG. 2 is an end view of the structure as seen from the right-hand end of FIG. 1.

The overall dimensions of the device 100 will vary depending upon the maximum size of the ground wire 600 which is to be accommodated. A clamp which will accommodate wire sizes up to 4/0 AWG may have an overall width of approximately two inches as seen in FIG. 1 and a width approximating 1½ inches as seen in FIG. 2. The ground bar may have a cross section of the order of 0.125 by 0.75 inches.

It will be appreciated that under some circumstances, it might be desirable to increase the width as seen in FIG. 2, and provide multiple screws 200 and 300. Also under some conditions and circumstances, it may be desirable to use multiple clamps 100 connecting between the same cable tray and ground wire. This could provide increased protection if a clamp 100 is subjected to physical damage or inadvertantly improperly installed or otherwise unable to function as intended.

While there has been shown and described what is considered at present to be the preferred embodiment of the invention, modifications thereto will readily occur to those skilled in the related arts. For example, in another structure a flexible grounding strap might be used and/or multiple clamping screws. In addition, the ground bar might have a special configuration to increase the area of contact with the clamped members. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described and it is intended to cover in the appended claims all such modifications as fall within the true spirit and scope of the invention.

What is claimed is:

1. A grounding lug for electrically coupling a ground wire and a cable tray, or the like, which comprises:

(a) a body member fabricated of a high-yield strength material and including an anvil portion at the bottom and an opposing top portion joined as an integral structure by a first side member;

(b) said anvil portion being "L" shaped in cross-section and having a leg along said bottom and an upstanding leg, said anvil portion including first and second anvil surfaces on said bottom leg and on the end of said upstanding leg;

(c) said top portion including first and second t hreaded holes opposite to said first and second anvil surfaces, respectively, for supporting first and second threaded clamping means;

(d) a grounding bar conforming to the shape of said anvil portion and having an end with a hook into which said upstanding leg extends, said grounding bar being fabricated of a material having a low-yield strength and superior electrical conducting characteristics, both as compared with said body member; and (e) said grounding bar overlays said first and second anvil surfaces; whereby said grounding bar provides a low resistance electrical path between the cable tray or the like, clamped by said first threaded clamping means and the ground wire or the like, clamped by said second threaded clamping means against said grounding bar and said anvil surfaces.

2. The grounding lug as set forth in claim 1 wherein said grounding bar is sized and fabricated of a material that permits it to conduct a current of the same magnitude as that which may be safely conducted by the maximum size ground wire accommodated by said grounding lug.

3. The grounding lug as set forth in claim 2 and including a second side member opposite said first side member.

4. The grounding lug as set forth in claim 3 wherein said first and second side members each include an upturned portion defining "C" shaped notches in each side member on opposite sides of said second anvil surface for retaining the ground wire in position prior to clamping thereof by said second clamping means.

5. A clamp for providing an electrical connection between first and second elements such as an electrical conductor and a cable tray, or the like and comprising:

(a) first and second conjoined clamping members having a common body member fabricated of a high-yield strength material for resisting deformation;

(b) said body member having an oppositely disposed anvil member and a top member joined as a single unit by a first side wall;

(c) first and second clamping means threadingly engaged with said top member and each projecting towards first and second portions of said anvil member, respectively;

(d) a low resistance conduction member having a thickness sufficient to carry safely at least as much current as said elements formed and positioned for contact with and support by said first and second portions of said anvil member whereby first and second elements laid over said first and secnd portions, respectively, of said anvil member, with said conduction member therebetween, are clampable by said first and second clamping means, respectively, for providing a low resistance conduction path between said first and second elements; and said first and second portions of said anvil member being non-coplanar, such that said first and second portions of said anvil member and said conduction member thereon are in different generally parallel planes.

* * * * *